United States Patent [19]

Wakabayashi

[11] 3,961,432

[45] June 8, 1976

[54] DIGITAL INDICATOR

[76] Inventor: Yasuo Wakabayashi, 1362-293, Hisaki, Zushi, Kanagawa, Japan

[22] Filed: Oct. 25, 1975

[21] Appl. No.: 518,083

[30] Foreign Application Priority Data

Oct. 26, 1973 Japan ..... 48-119836

[52] U.S. Cl. ..... 40/28 C

[51] Int. Cl.[2] ..... G09F 11/00

[58] Field of Search ..... 40/28 R, 28 E, 28 C; 340/378 R, 378 A

[56] References Cited

UNITED STATES PATENTS

| | | | |
|---|---|---|---|
| 3,399,474 | 9/1968 | Rinder | 40/28 C |
| 3,399,475 | 9/1968 | Rinder | 40/28 C |
| 3,552,048 | 1/1971 | O'Keefe | 40/28 C |
| 3,579,879 | 5/1971 | Samuels | 40/28 C |
| 3,683,523 | 8/1972 | Boyles | 40/28 C |
| 3,837,102 | 9/1974 | Golay | 40/28 C |

*Primary Examiner*—Edgar S. Burr
*Assistant Examiner*—A. Heinz
*Attorney, Agent, or Firm*—Lane, Aitken, Dunner & Ziems

[57] ABSTRACT

A segment type digital indicator, which displays flat and easy to read large dotted figures clearly in daylight, as well as at night, includes a masking plate having dotted apertures, segment shutter plates having vertically disposed arm members and mounted immediately behind the masking plate, a reflecting plate mounted immediately behind the segment shutter plates, and operating means connected to the vertically disposed arms of the segment shutter plates to operate the segment shutter plates in sequence for displaying dotted numerals from "0" through "9", or other dotted figures, on the masking plate.

11 Claims, 20 Drawing Figures

DIGITAL INDICATOR

BACKGROUND OF THE INVENTION

This invention relates to a digital indicator which is simple in construction yet capable of displaying flat and easy to read large dotted figures clearly in daylight as well as at night.

Digital indicators are not widely used in various devices such as counters, meters, clocks and the like. This invention provides an improved segment type digital indicator wherein seven, eight or nine segments are used to form Arabic characters from "0" through "9".

For example, U.S. Pat. No. 3,683,523 to Boyles describes a 7-segment type digital indicator wherein a vertically movable shutter having horizontal segments and a horizontally movable shutter having vertical segments are mounted behind a front panel which is provided with seven straight-line slots in the form of the figure "8". With the Boyles device the numerals from "0" through "9" are formed from seven straight-line indicator segment slots in the front panel when the vertically and horizontally movable shutters are selectively moved relative to each other. This type of digital indicator has certain drawbacks in that illumination of the figures is almost impossible without an internal light source and the visibility of the displayed figures is poor when a strong outside light shines upon the front panel of the indicator. Another difficulty usually encountered with the prior art segment type digital indicators of the Boyles type is that incorrect figures are displayed on the front panel during the transition between the disappearance of a numeral and the appearance of the next numeral. For example, when the figure on display is changed from " 3" to "4", the numerals "7" and "9" appear in sequence before the figure "4" is finally displayed. Similarly, when the figure is changed from "4" to "5", the numerals "0", "8" and "6" sequentially appear on the front panel during the transition between the disappearance of the figure "4" and the appearance of the intended figure "5". This latter deficiency is due to the fact that a number of opaque shutter bars on both the vertically movable shutter and the horizontally movable shutter form unnecessary combinations while both shutters are moved and is considered to be a detrimental defect inherent to the construction of the indicator.

Digital indicators having rotary cylinders which bear printed numerals on the circumferential surfaces thereof are also known in the art. The rotary cylinder type digital indicators have been widely used, for example, as mileage-meters for motor vehicles. However, with these rotary type indicators the displayed figures are small as compared to the bulky operating mechanism, and are difficult to read because they are printed on a curved surface.

Accordingly, it is an object of the present invention to provide a segment type digital indicator which will overcome the aforementioned difficulties and drawbacks of the prior-art digital indicators.

It is another object of the present invention to provide a digital indicator which is capable of displaying flat and easily readable dotted figures clearly in daylight as well as at night.

It is a further object of the present invention to provide a segment type digital indicator which can display digital figures with a sophisticated effect comparable to that of an expensive luminous diode digital display indicator such as is used for sophisticated computers.

It is a still further object of the present invention to provide a segment type digital indicator which is able to display figures precisely, with no display on the front panel during the transitional time period between disappearance of a numeral and appearance of the next intended numeral.

It is a further object of the present invention to provide a segment type digital indicator which is simple in construction, simple in operation, extremely low in operational noise, and reliable in operation.

SUMMARY OF THE INVENTION

It has now been found that the foregoing and related objects can be readily attained by a segment type digital indicator including: a flat and rigid masking plate having seven, eight, or nine segment apertures where each segment aperture is formed of a plurality of smaller apertures; segment shutter plates each movably mounted behind said masking plate in a common plane and having a vertically disposed arm member and a face of a color matching that of the masking plate and located in a predetermined position on the arm member; a reflecting plate mounted immediately behind said segment shutter plates and having a face of a color different from that of the masking plate; and operating means operatively connected to the arm members or extensions of the segment shutter plates for moving the segment shutter plates in sequence in a vertical direction for a short distance between covering and uncovering positions with respect to the segment apertures for displaying the dotted numerals from "0" through "9" sequentially on the masking plate.

The above and other objects, features and advantages of the invention will become apparent from the following description and the appended claims, taken in conjunction with the accompanying drawings which show, by way of example, the preferred embodiments of the invention.

PARTICULAR DESCRIPTION OF THE PREFERRED EMBODIMENTS OF THE INVENTION

Figure 1:
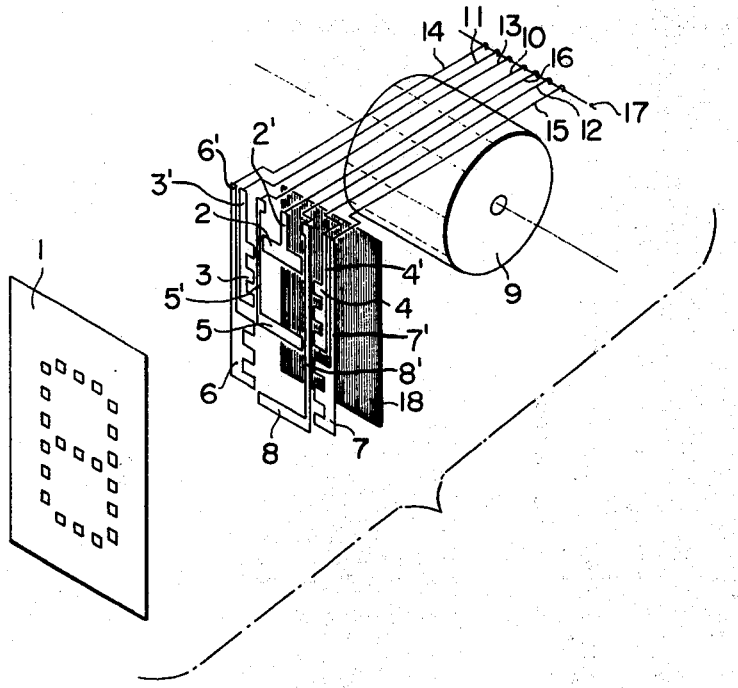
FIG. 1 is an exploded perspective view of one embodiment of the segment type digital indicator of the present invention.

Referring to FIG. 1, the 7-segment type digital indicator of the present invention includes an opaque, rigid and flat masking plate 1 which is formed with 21 small square apertures, three for each of the seven segments which are disposed to form a figure "8" in the manner of a conventional 7-segment indicator. In the embodiment shown in FIG. 1, the masking plate 1 has a white face. Mounted immediately behind the masking plate 1 are seven segment shutter plates 2 to 8, which are mounted in a common plane and movable vertically in parallel to the masking plate 1. Plates 2–8 move only a short distance which distance is almost the same as the distance across one of the square apertures. The segment shutter plates 2 to 8 each have a vertically disposed arm member or extension, 2' to 8', and have a face colored similar to the masking plate 1.

The 7-segment type digital indicator of FIG. 1 further includes a reflecting plate 18, which is mounted immediately behind the segment shutter plates 2 to 8, and which has a red colored highly reflective front surface. The vertically disposed arms, 2' to 8', of the respective segment shutter plates 2 to 8 are connected at their upper ends to cam followers 10 to 16, respectively. The opposite ends of cam followers 10 to 16 are supported by a common supporting shaft 17. The cam followers 10 to 16, which are disposed side by side like comb teeth on rotary cam member 9, operate segment shutter plates 2 to 8 to move them vertically over a short distance in sequence and to move each segment shutter plate between covering and uncovering positions with respect to the segment apertures, thereby forming figures from "0" through "9" sequentially in the manner described below.

Figure 2:
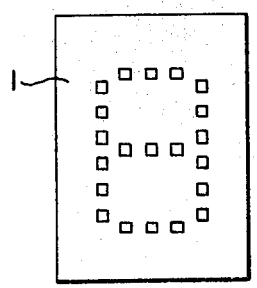
FIG. 2 is a front elevational view of the digital indicator of FIG. 1 in an assembled state.

The masking plate 1 and the reflecting plate 18 are mounted as closed to each other as possible, with the segment shutter plates 2 to 8 interposed therebetween. In FIG. 2, the segment shutter plates 2 to 8 are in their lower or covering positions. In FIG. 2, no figure appears on the face of the white masking plate 1 since all of the small square apertures are covered by the shutter plates.

Figure 3A:
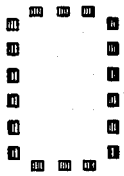
FIGS. 3*a* to 3*j* are diagrammatic views showing figures which may be displayed by the indicator.

Upon rotating the cam member 9 clockwise about its rotational axis through 18°, the cam followers 10 to 12 and 14 to 16 are raised to lift the arm members of the segment shutter plates 2 to 4 and 6 to 8 a short vertical distance. The raised white segment shutter plates 2 to 4 and 5 to 8 are thus hidden from view behind the masking plate 1 to uncover 18 of the 21 small square apertures and to expose the red reflecting plate 18 through the uncovered apertures. In this manner, the figure "0" is displayed in red dots on the white masking plate 1 as shown in FIG. 3*a*.

Figure 3B:
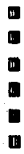

If the cam member is rotated clockwise an additional 18 degrees, the cam followers 2 to 4 and 6 to 8 are lowered to return to their lower or covering positions as in FIG. 2, and the red dotted figure "0" on the masking plate 1 disappears since all of the small square apertures are again covered by the white segment shutter plates. When the cam member 9 is rotated clockwise an additional 18°, or 36° from the "0" position, the cam followers 12 and 15 are raised to lift the segment shutter plates 4 and 7 to their upper or uncovering positions, uncovering 6 small square apertures and allowing the red reflecting plate 18 to show therethrough. In this manner, the figure "1" is displayed in red dots on the white masking plate 1 as shown in FIG. 3*b*.

Figure 3C:
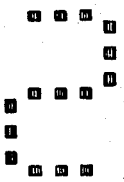
Figure 3D:
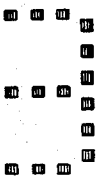
Figure 3E:
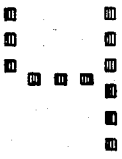
Figure 3F:
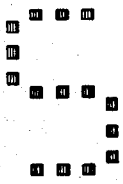
Figure 3G:
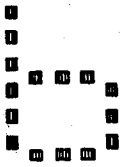
Figure 3H:
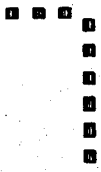
Figure 3I:
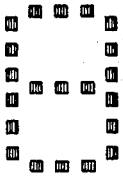
Figure 3J:
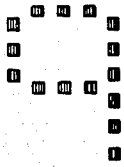

Similarly, when the cam member is rotated clockwise still an additional 18° from the "1" position, the cam followers 12 and 15 are lowered and the red dotted figure "1" on the masking plate 1 disappears since all of the small square apertures are again covered by the respective white segment shutter plates. When the cam member is rotated clockwise 36° from the "1" position, the cam followers 10, 12 to 14 and 16 are lifted and the segment shutter plates 2, 4 to 6 and 8 are raised and hidden behind the masking plate 1, uncovering 15 small square apertures to display the figure "2" in red dots on the white masking plate 1 as shown in FIG. 3*c*. In a similar manner, with every clockwise 36° rotation of the cam member 9, the seven cam followers are operated in predetermined sequence to display the figures "3" to "9" in red dots on the masking plate 1 as shown in FIGS. 3*d* to 3*j*. Thus, the ten red dotted figures from "0" through "9" are displayed sequentially on the masking plate 1 by one entire revolution (360°) of the cam member 9, without showing figures during the transition between changing numerals.

In the foregoing description of the invention, the faces of the masking plate 1 and the respective segment shutter plates are described as being white and the reflecting plate 18 as being red. However, other contrasting colors may be employed. For example, the masking plate and reflecting plate may each have a matted black face, and be used in combination with segment shutter plates of a white color. In this instance, the segment shutter plates are operated in inversed combinations and the figures are displayed in white dots on a black background with high contrast.

Figure 4:
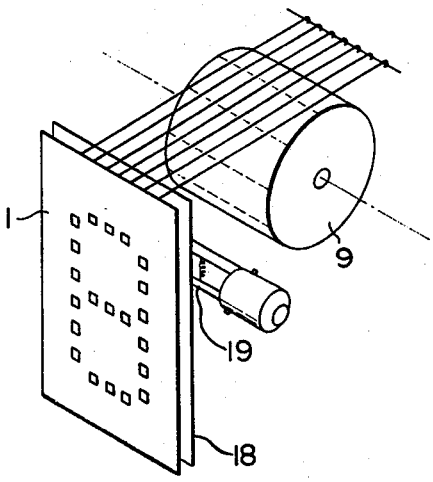
FIG. 4 is a perspective view showing a modified embodiment of the invention which employs an internal light source for positively illuminating the displayed figures through a translucent reflecting plate.

FIG. 4 shows a modified construction of the segment type digital indicator of the invention, wherein the indicator has the same construction as the embodiment shown in FIG. 1 except that an internal light source such as an electric lamp 19 is provided and the red reflecting plate 18 is formed from a red translucent material. With this arrangement, illuminated red dotted figures are displayed on the masking plate 1. With this embodiment, if the masking plate 1 and the segment shutter plates are black-faced, it is possible to give a sophisticated display effect similar to that of the expensive luminous diode digital indicators used with sophisticated computers.

Figure 5A:
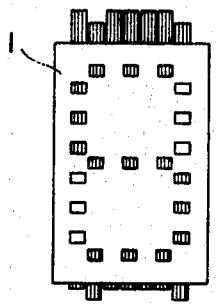
FIG 5*a* is a front elevational view of another embodiment of the invention in which the reflecting surface is a plurality of vertically disposed arm members.
Figure 5B:
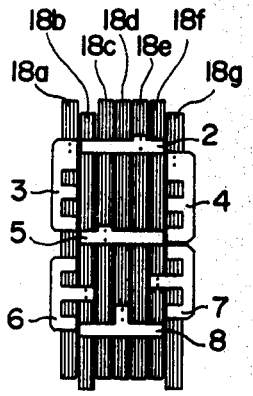
FIG. 5*b* is a front elevational view of the embodiment of FIG. 5*a* but with the masking plate removed.
Figure 5C:
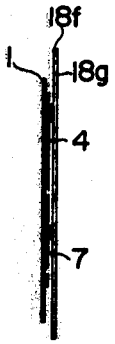
FIG. 5*c* is a right side view of the embodiment of FIG. 5*a*.

FIG. 5*a*, FIG. 5*b* and FIG. 5*c* show another modified embodiment of the present invention in which the faces of vertically disposed arms 18*a* to 18*g* serve as a reflecting plate and the separate reflecting plate is eliminated.

Figure 6A:
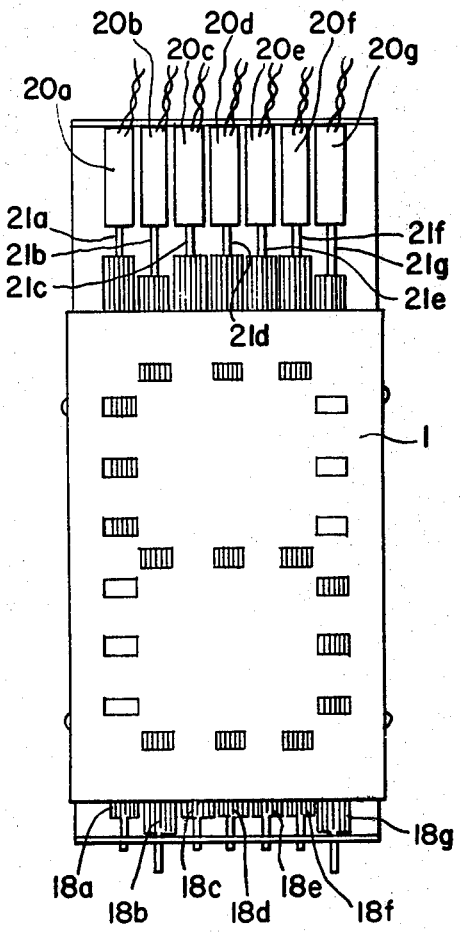
FIG. 6*a* is a front elevational view of another embodiment of the invention in which each individual vertically disposed arms are operated in sequence directly by means of an electromagnet.
Figure 6B:
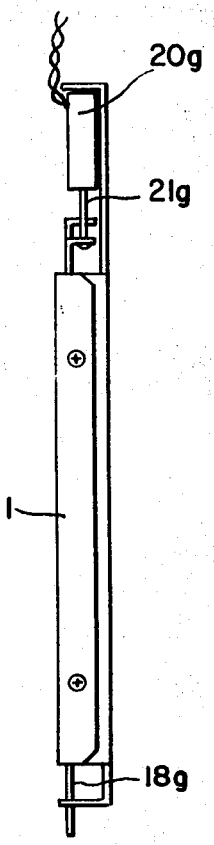
FIG. 6*b* is a right side view of the embodiment of FIG. 6*a;*
Figure 7A:
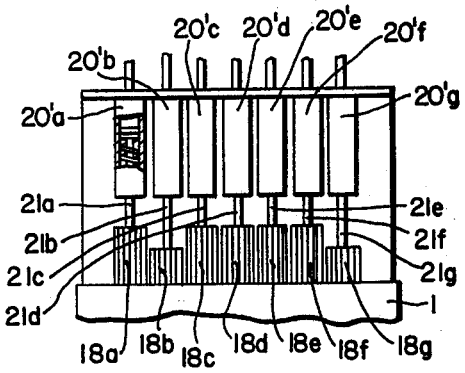
FIG. 7*a* is a fragmentary front elevational view of a further alternative embodiment of the invention.
Figure 7B:
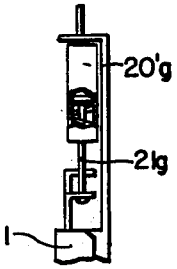
FIG. 7*b* is a right side view of the embodiment of FIG. 7*a*.

As can readily be appreciated from FIGS. 1, 5*a* and 5*b*, each individual vertically disposed arm can be operated in sequence directly by means of an electromagnet as illustrated in FIG. 6*a* and FIG. 6*b*, thereby dispensing with the cam and its followers. In this arrangement vertically disposed arms 18*a* to 18*g* are operated in sequence directly by movable iron plungers 21*a* to 21*g* of cylindrical plunger magnets 20*a* to 20*g*. Such a modification makes it possible to operate the digital indicator of the present invention directly in response to an electric signal if desired. It can also readily be seen that suitable operating means, other than electricity, can be used to transmit the rectilinear motion to the shutter plates, i.e., pneumatic means using compressed air or other pressurised fluid. Such pneumatic means for effecting rectilinear motion of the shutter plates is illustrated in FIGS. 7*a* and 7*b*, fluid motors designated by reference numerals 20'*a* through g being substituted for the electromagnets 20*a*–20*g* of FIGS. 6*a* and 6*b*.

As it is apparent from the foregoing, the simple but efficient digital indicator of the present invention provides a display of flat and easy to read large digital figures in daylight as well as at night. Furthermore, the indication of figures of the present invention is quite precise and nothing is indicated during the transition of changing figures. Furthermore, it is possible to install an internal light source in the digital indicator of the present invention to display illuminated figures in the dark and thereby effect a rather sophisticated display. Also, the mechanism of the present invention has almost no working noise, and makes it possible to construct silent clocks and counters. The digital indicator of the present invention can also be easily modified to operate directly through an electric signal.

I claim:

1. A segment type digital indicator, comprising:

a masking sheet having an exposed face of one color and apertured areas arranged to represent at least seven digit segments;

shutter plates movably mounted in a common plane behind and parallel to said masking sheet, each of said shutter plates having at least one segment shutter portion of said one color for covering one of said apertured areas representing a digit segment;

means defining a planar surface of another color contrasting with said one color mounted immediately behind said shutter plates; and operating means including aligned drive elements movable in parallel paths and independently movable members connecting said drive elements with said shutter plates, respectively, said drive elements being selectively operative to move said shutter plates in said common plane between covering and uncovering positions with respect to said apertured areas of said masking sheet to selectively expose said surface of contrasting color through said apertured areas representing one or more of said digit segments to form an alphanumeric character.

2. The apparatus recited in claim 1 wherein said apertured areas representing said digit segments respectively are defined by aligned spaced apertures in each digit segment, certain of said segment shutter portions being of a size in relation to said apertures and spacing thereof so that said certain segment shutter portions may be located between said aligned apertures in said uncovering position.

3. The segment type digital indicator of claim 1 wherein said apertures in said masking sheet are square.

4. The segment type digital indicator of claim 1, wherein said means defining a planar surface is a translucent sheet and further comprising an internal light source mounted immediately behind said translucent sheet.

5. The segment type digital indicator of claim 1, wherein said operating means comprises means for transmitting motive force from compressed air or a pressured liquid.

6. A segment type digital indicator, comprising:

a masking sheet having an exposed face of one color and apertured areas arranged to represent at least seven digit segments;

shutter plates movably mounted in one common plane behind and parallel to said masking sheet, each of said shutter plates having a segment shutter portion of said one color for covering one of said apertured areas representing a digit segment;

arms to individual support each said shutter plates, all said arms being movable in linear paths parallel to each other and to said common plane means defining a planar surface of another color contrasting with said one color mounted immediately behind said shutter plates; and operating means connected to said shutter plates for independently moving said shutter plates in said common plane between covering and uncovering positions with respect to said apertured areas of said masking sheet to selectively expose said surface of contrasting color through said apertured areas representing one or more of said digit segments to form an alphanumeric character, said apertured areas representing said digit segments respectively being defined by aligned spaced apertures in each digit segment, certain of said segment shutter portions being of a size in relation to said apertures and spacing thereof so that said certain segment shutter portions may be located between said aligned apertures in said uncovering position.

7. The apparatus recited in claim 6 wherein said planar surface defining means includes said arms.

8. The apparatus recited in claim 6 wherein said arms are located for movement behind said masking sheet out of alignment with said apertures.

9. The apparatus recited in claim 8 wherein said means defining a planar surface comprises a translucent sheet and comprising further, a light source behind said translucent sheet.

10. The segment type digital indicator of claim 6, wherein said operating means comprises a rotary cam member having a surface of a predetermined configuration, and a number of cam followers disposed side by side on said rotary cam member, each of said cam followers being connected at one end to one of said arms.

11. The segment type digital indicator of claim 6, wherein said operating means comprises electromagnets which transmit said linear motion to said arm members.

* * * * *

UNITED STATES PATENT OFFICE
CERTIFICATE OF CORRECTION

Patent No. 3,961,432 Dated June 8, 1976

Inventor(s) Yasuo Wakabayashi

It is certified that error appears in the above-identified patent and that said Letters Patent are hereby corrected as shown below:

Title Page, Item [22] is "October 25, 1975" should read --October 25, 1974--.

Substitute Fig. 1 for the drawing figure which appears on the title page of the patent, the latter relating to subject matter not concerned with the patent.

Column 1, line 9 "not" should read --now--.

Column 6, line 19, "individual" should read --individually--.

Signed and Sealed this

Seventh Day of December 1976

[SEAL]

*Attest:*

RUTH C. MASON
*Attesting Officer*

C. MARSHALL DANN
*Commissioner of Patents and Trademarks*